US006464467B2

(12) United States Patent
Sullivan et al.

(10) Patent No.: US 6,464,467 B2
(45) Date of Patent: Oct. 15, 2002

(54) INVOLUTE SPIRAL WRAP DEVICE

(75) Inventors: Timothy J. Sullivan, Dublin; David A. Ball, Westerville; Donald Anson, Worthington, all of OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 09/681,363

(22) Filed: Mar. 26, 2001

(65) Prior Publication Data

US 2001/0043878 A1 Nov. 22, 2001

Related U.S. Application Data

(60) Provisional application No. 60/193,710, filed on Mar. 31, 2000.

(51) Int. Cl.[7] ..... F04B 19/24; F04B 49/00; F04B 17/00; F01C 1/02

(52) U.S. Cl. ..... 417/53; 417/295; 417/410.5; 418/60

(58) Field of Search ..... 417/53, 295, 298, 417/60, 410.5, 441, 310, 422, 214

(56) References Cited

U.S. PATENT DOCUMENTS

| | | | | | |
|---|---|---|---|---|---|
| 4,950,135 | A | * | 8/1990 | Tojo et al. | 417/410 |
| 5,074,761 | A | * | 12/1991 | Hirooka et al. | 417/310 |
| 5,123,818 | A | * | 6/1992 | Gormley et al. | 417/410 |
| 5,295,808 | A | * | 3/1994 | Machida et al. | 417/366 |
| 5,857,348 | A | * | 1/1999 | Conry | 62/209 |

OTHER PUBLICATIONS

Tanaka, Hideki; Usui, Sanpei; Solar–Powered Air–Conditioner Technology; Hitachi Review; 1981; 25–30; vol. 30, No. 1.

Zanelli, R.; Favrat, D.; Experimental Investigation Of A Hermetic Scroll Expander–Generator; 459–464, (no date given).

Nagatomo, Shigemi; Inou, Toshitsune; English translation of Japanese Patent Application Application No. 2–243612, Apr. 1992.

* cited by examiner

*Primary Examiner*—Charles G. Freay
*Assistant Examiner*—Michael K. Gray
(74) *Attorney, Agent, or Firm*—Killworth, Gottman, Hagan & Schaeff LLP

(57) ABSTRACT

An involute spiral wrap scroll-type device uses two pairs of spiral wrap members connected together at opposite ends of a common rotational shaft. The device can be operated in either an expansion mode or a combination hybrid mode where each pair of spiral wrap members functions as a compressor and expander, respectively. In an expansion mode, electric current is produced via generator electrically responsive to shaft rotation. In hybrid mode, a first spiral wrap member pair functions as an expander with the second spiral wrap member pair functioning as a compressor. In this mode, the balance of shaft power between that produced by the expander and that absorbed by the compressor is either supplied by the motor/generator functioning as a motor, or converted into electricity by the motor/generator functioning as a generator. The housing can be hermetically sealed, thus promoting contamination-free operation. A throttle valve is used to control shaft rotational speed and to regulate the electric current output of the motor/generator. A differential pressure valve is used to control adverse pressure conditions in the spiral wrap members. At least one of the orbiting scrolls can be used to drive a pump. A heat exchanger is used in conjunction with a stator on the motor/generator.

30 Claims, 7 Drawing Sheets

INVOLUTE SPIRAL WRAP DEVICE

CROSS REFERENCE TO RELATED APPLICATIONS

This application claims the benefit of U.S. Provisional Application No. 60/193,710 filed Mar. 31, 2000.

BACKGROUND OF INVENTION

This invention pertains generally to an involute spiral wrap (also known as a scroll) device with more than one pair of spiral wrap members, and more particularly to a pair of axially opposed scroll members operatively coupled through a common linkage to both an electric motor/generator and an auxiliary power device, all inside a hermetically sealed power module. The device has particular utility when used in one of two operating modes; first in an expansion mode, where the electric motor/generator functions solely as a generator, and is disposed on a rotational shaft coupled through the linkage to the scroll devices such that the conversion of shaft to electric power is enabled, and second, in a hybrid, or combination, mode, where simultaneously one scroll functions as an expander while the other functions as a compressor.

The use of meshed involute spiral wraps for both engine and compressor applications has been known since the early twentieth century. For example, U.S. Pat. No. 801,182 to Creux shows and describes the salient features of such a device, including the interspersing of two spiral bands that define radially intermittent, crescent-shaped chambers, and that the device can be used alternatively as an expander or compressor. The chambers are radially intermittent in that they translate radially between the center and the outer edge in response to the relative movement between the fixed and orbiting scrolls. Over the years, many improvements have been made to the design, increasing capacity, efficiency and system responsiveness. Additional features, such as modular componentry, lightweight materials for orbiting parts and hermetic sealing have all been employed in varying degrees. However, the demand for more throughput has resulted in both larger, more volume-intensive configurations, as well as having pushed the mechanical limits of conventional spiral wrap devices, with unbalanced thrust forces, higher operating temperatures and greater bearing loads placing considerable stress on the componentry. This in turn led to shorter part life and increased operational expense, thus hampering scroll device viability.

To meliorate this concern, larger bearing assemblies and shaft end housings to handle the thrust forces of the wrap members were added, as well as heat exchange devices to remove excess heat. Unfortunately, these solutions add to system volume, weight, complexity and cost. Another approach taken was to place back-to-back orbiting scrolls on a common shaft, each operably engaged with a stationary scroll. While this approach increased device capacity and reduced unbalanced axial loads, it also resulted in mechanical complexity and compromised discharge porting designs that presented new problems. Lighter weight materials were applied, most notably aluminum alloys and aluminum-based composites, to the orbiting scroll in an attempt to reduce inertial loading on the bearings, as well as to permit higher rotational operating conditions and lower differential radial pressure variations. However, additional manufacturing cost coupled with higher than acceptable wear rates adversely effected the viability of these lightweight material systems.

Other problems unique to scroll devices also became apparent. In expansion mode, the fixed volume-ratio scroll device will attempt to operate to a nearly fixed pressure ratio. This fixed pressure ratio constraint will force the working fluid within the expansion chamber to drop below the discharge cavity pressure, thus adversely impacting the efficiency of the scroll device.

Another traditional problem for refrigeration-cycle scroll devices pertains to their housing and containment. Hermetic sealing of housings offered twofold benefits: first, the sealing could protect the internal machinery when employed in harsh environs, where dirt, moisture and corrosives could adversely effect scroll performance and life; and second, with the increasing use of scroll devices in locations intolerant of the noise and mess associated with power-generating machinery, the clean, relatively maintenance-free operation of the hermetic scrolls meant their use could be placed in close proximity to such sensitive areas. While some scroll units utilize hermetic sealing, none fully integrate hermetic sealing with compact, fully autonomous operation that includes internal auxiliary power sources (for example, to drive lubrication and condensate pumps), as well as an unobtrusive cooling mechanism to meet the extra cooling demands of a hermetically sealed, high-output electrical generator, coupled inlet throttle control, integrated oil separation and fully automated operation.

Accordingly, the need exists in the art for a power generation system that can utilize the inexpensive, compact and reliable features of a scroll device in an expansion mode as well as a hybrid mode, both of which require high capacity, mechanical and speed/condition flexibility and fully autonomous operation.

SUMMARY OF INVENTION

According to an aspect of the present invention, an involute spiral wrap device is disclosed. It comprises a housing in which two pairs of meshed axially extending involute spiral wrap members are opposedly mounted on a common shaft, an antirotation device and eccentric linkage, or pin, to convert orbital movement to shaft rotational movement, an electric motor/generator in inductive electrical communication with the shaft, an auxiliary power source, a heat exchange system to exchange heat with the stator of the motor/generator, and at least one differential pressure valve to avoid or minimize select adverse pressure gradient conditions. The present invention features the use of a first pair of spiral wrap members oriented coaxially with, but in opposite direction to a second pair of spiral wrap members. By reducing the width of the scroll and placing the load on two spiral wrap member pairs, rotationally-induced scroll material stresses are reduced significantly. In addition, these reductions in rotationally-induced scroll loads leads to significant reductions in bearing size, bearing mechanical losses and to the size of related structural members. To minimize the radial forces of the spiral wrap pairs, the present invention features the use of one or more counterweights formed as part of the rotatable shaft. When the spiral wrap member pairs are operated in expansion mode, the electric motor/generator, which includes a shaft mounted rotor and stator, can be run solely as a generator which produces an electrical potential, thereby converting shaft horsepower generated by the expansion of a pressurized working fluid through the wrap members to alternating current electricity. The electrical energy can be passed through the walls of the housing through electrical conductors without the need for housing shaft seals that are typically required when using mechanical energy transmission, thereby preserving the hermetic sealing features. In the hybrid mode, one of the pairs of meshed involute spiral wrap members is responsive to energy input from the electric motor/generator, now functioning as a motor. As an external electrical potential is applied to the stator coils, it induces the rotor to turn, thereby rotating the shaft, which, through its coupling to the orbiting scroll, can compress the working fluid as it enters the chamber from its outer radial position and flows through the radially-inward moving crescent chambers to the center of the wrap members and out the scroll member discharge (thus acting as a compressor). Meanwhile, the other spiral wrap member pair is responsive to the input of high pressure working fluid through the throttle valve (thus acting as an expander), which is therefore capable of providing power to the common shaft, resulting in a concomitant reduction of external electric power required of the motor/generator to run the compressor. The electric motor/generator may, in the alternate, be divided up into separate modules, each in operable communication with the rotating shaft, with each dedicated to one or the other of the motor and generator functions. Some of the details pertaining to the particular components are presented in the following paragraphs.

For many applications, it is desirable to hermetically seal the operating components of the scroll unit in the housing to provide isolation of the internal components from an external (i.e.: outside the housing) environment. In the scroll device of the present invention, the hermetic housing defines an internal ambient environment that is largely isolated from conditions outside the housing. For ease of assembly and subsequent access, the housing is formed as two or more sections with flanges that may be sealed together using an O-ring and mechanical fasteners. Optionally, the housing may be more permanently sealed such as by welding, soldering, or brazing of the sections. The simplification and elimination of many of the moving parts and minimization of previously difficult to control radial and thrust forces associated with the scroll unit make the permanently sealed housing possible. This is especially true when the scroll unit is used for applications in which no shafts are required to penetrate the housing. In the preferred embodiment, only working fluid and stator coolant inlets and outlets, as well as electrically conductive lines, penetrate the housing boundary. Internal manifolded networks are set up, either inside or outside the housing to distribute the working fluid between the inlet, outlet and spiral wrap pairs. One of the members of each scroll pair can have an intake or discharge left open to the interior volume of the housing, known as the fluid expansion volume, for fluid communication with an inlet or outlet housing port.

The throttle valve is used to regulate working fluid flow such that the scroll device is responsive to varying load demands. It is anticipated that the scroll unit of the present invention will be used under a wide variety of load conditions. With many of these applications, such as the production of a constant electrical potential, it is desirable to control the rotational speed of the rotatable disk to ensure the generator produces a constant alternating current frequency. To this end, a throttle valve is used with the working fluid with the valve responsive to the rotatable disk rotational speed. One of the ways that this can be achieved is by coupling the valve to a conventional speed sensor that detects the rotational speed of the rotatable disk, such that a feedback-based controller loop is established. The chief attributes of the throttle valve is that it is a much less expensive way of controlling the operating frequency of the output voltage than by using signal conditioning electronics, and that it helps the scrolls to operate at a fixed rotational speed, thereby improving efficient scroll operation.

Because the spiral wrap members define a crescent-shaped translatable moving chamber with specific volume characteristics, it is possible that under certain conditions the pressure in the chamber near the outlet of the spiral wrap members may fall below the internal ambient pressure. As a result, the unit becomes less efficient as additional work must be done to achieve the desired flow. To this end, one or more differential pressure valves are used with ports that can access the crescent-shaped translatable chamber under these select, adverse pressure gradient situations where, if the pressure in the chamber were to fall below that of the internal ambient pressure within the housing, the valve opens to allow the pressure to adjust to the desired level. For example, a wrap pair unit operating in expansion mode at an off-design condition may exhibit some of these adverse pressure gradients. When such a counterproductive pressure level is achieved, the valve opens, thus allowing the pressure inside the scroll chamber to reach a more desirable output level, and thereby enhancing working fluid flow.

Optionally, the involute spiral wrap device includes at least one axial compliance member to minimize leakage in between the fixed and orbiting scroll members. Preferably, the axial compliance member can be an integral tension feature, tip seals, or a combination of both. The integral tension feature would use a pressurized fluid or a spring-loaded device to axially push the fixed scroll toward the orbiting scroll under these high pressure conditions. The tip seals, which can be mounted in a groove at the top of either or both of the scroll wraps, is itself biased against the surface of the end plate of the intermeshed wrap. Compliance for the tip seals can come from inherent springiness in the tip seal material itself, or through a backside biasing due to pressurized fluid, for example.

The eccentric pin, in conjunction with the antirotation device, converts the orbiting motion of the orbiting scroll to circular (rotational) shaft motion. The eccentric pin is fixed at each opposing shaft end to an end plate of the orbiting involute spiral wrap member pair such that the central axis of the orbiting scroll and the eccentric pin are off-center relative to the central rotational axis of the rotatable shaft. An aperture in the end plate of each of the orbiting scrolls is placed a radial distance from the central rotational axis of the shaft equal to that of the orbiting radius of the orbiting scroll. The eccentric pin and shaft assembly are supported by journal bearings and mechanically connected to the orbit scroll aperture by means of an eccentric bushing. In addition to the eccentric pin, the antirotation device, such as an Oldham coupling or a ball ring assembly, is coupled on one side to the orbiting scroll, and on the other side to either the fixed scroll or the stationary support member within the hermetically sealable housing. In the former, protruding detents from the coupling interact with complementary indentations on both the fixed and orbiting members to restrict the range of motion and rotation of the orbiting scroll, while in the latter, a series of balls are placed between two parallel plates that have slightly oversized mirror-image cylindrical cutouts such that each of the balls is disposed in its own chamber defined by the opposing, aligned cutouts.

Various system operability features are required, including the circulation of oil and related lubricants through the components mounted within the housing, as well as separation of the lubricant from the working fluid, and moving the working fluid between various components as part of a conventional Rankine cycle, for instance. The hermetic nature of the device makes it more challenging to achieve this objective, as the presence of external rotating shafts (which need shaft seals at any point that passes through the housing wall) to provide these features would tend to defeat the purpose of having a hermetic device in the first place. In many rotating machinery applications, it is often necessary to have a pump that may be used to provide lubrication of the various components, including the spiral wrap pair, shaft, rotor and bearings. By placing the lubrication circuit internal to the hermetic shell, the scroll device can operate in environments requiring high degrees of cleanliness. To this end, the auxiliary power source can be either a simple reciprocating lubrication pump (driven directly by the eccentric motion of one of the orbiting spiral wrap members), or a simple rotational pump powered indirectly off the orbiting spiral wrap member through a bearing arrangement from the shaft. Furthermore, it is possible to have both a high pressure and low pressure lubrication circuit. The high pressure circuit is used to coat the scroll components themselves, which operate in a high pressure environment. With this circuit, the lubrication system can achieve full coating of critical components by injecting oil into the scroll inlet port. The low pressure circuit is used to coat the bearings and related componentry. Examples of reciprocating pumps include: a follower wheel at the end of a piston rod may be held in contact with an orbiting surface of the wrap member by means of a return spring; or the piston rod may be mechanically linked to an orbiting surface of the involute spiral wrap member with a pivoting link arm fastened to the orbiting scroll member and the piston rod by means of apertured tangs and wrist pins.

An oil mist separator can be employed to "dry" the working fluid prior to exiting the power module. Here, a passive device may be employed to permit the oil mist droplets to first coalesce on the walls, then second, be fed back (under the force of gravity) into an oil sump. The "dried" working fluid may then be discharged. The auxiliary power source can also be used to act as or drive a condensate pump, which can be used to boost the pressure of the working fluid or other refrigerant during the post-condenser phase of a conventional Rankine cycle. The auxiliary power source may also provide a pump to transport condensed working fluid. For example, in an expansion mode, after the working fluid has expanded (typically to a vapor form), it passes through a condenser to convert it to a low pressure, low temperature liquid. From there, it passes through a condensate pump for conversion into a high pressure liquid, then to an evaporator/boiler to be flashed into a high temperature, high pressure gas. From here, the working fluid can be expanded in a scroll expander to produce work.

It is to be noted that in many applications, e.g., thermodynamic cycles, it is desirable to exchange heat with the working fluid. With higher capacity throughput made possible by the dual scroll device coupled with the relative thermal isolation of the components situated inside a hermetically sealed housing, the present inventors have discovered that supplemental cooling approaches are especially warranted. One location is the generator/motor, where the stator windings are subjected to increased current, and thus need to be cooled by proximate passages that transport conventional cooling fluid, such as oil, refrigerants, water, adjacent the stator so that substantial heat exchange is effected. For this purpose, the current invention features a stator heat exchanger placed at the outer radial edge of the stator. A wide variety of designs may be employed of which the following preferable embodiment is illustrative. In the preferable configuration, the heat exchanger includes a helical coil that surrounds either the stator directly, or through a specially adapted thermally conductive annular housing, in either case maintaining close proximity with the heat source in the stator. Stator coolant lines penetrate the housing and carry the excess heat away from the stator to an external device or location.

According to another aspect of the invention, a hybrid scroll device is disclosed. The hybrid scroll device includes a hermetically sealable housing with at least one working fluid inlet and at least one electrically conductive power line disposed across a boundary of the hermetically sealable housing, a scroll expander pair disposed within the housing, a scroll compressor pair substantially axially aligned with but oppositely oriented to the scroll expander pair, a rotatable shaft disposed between the scroll expander pair and the scroll compressor pair such that the shaft maintains them in an axially spaced relationship, an electric motor in cooperative engagement with the shaft, and a linkage coupled to the shaft such that the linkage is eccentrically mounted relative to a central rotation axis of the shaft. The housing defines an interior ambient environment. The scroll expander pair includes at least one working fluid inlet, and at least one working fluid outlet, each of which is disposed across a boundary of the housing. The scroll expander pair is adapted to accept high pressure working fluid in its one or more working fluid inlets, and as the working fluid proceeds in a radially outward path through the crescent-shaped translatable chamber, its pressure drops. In addition, it includes a fixed scroll and an orbiting scroll, each with an end plate and an involute spiral wrap attached thereto, as well as at least one generally crescent-shaped translatable chamber formed by the juxtaposition of the orbiting and fixed scrolls. The crescent-shaped translatable chamber is capable of radial movement upon the relative movement of the orbiting and fixed scrolls. A fluid path is defined by a scroll intake and a scroll discharge, separated from one another by the crescent-shaped translatable chamber. The fluid passage, from the scroll intake, through the generally crescent-shaped translatable chamber, and out the scroll discharge, is operatively responsive to the orbital movement of the orbiting scroll, and vice-versa. In addition, the device includes a rotation prevention apparatus coupled to at least the orbiting scroll. The scroll compressor pair is configurationally similar to that of the scroll expander pair save that the scroll compressor pair is oriented in the opposing axial direction, and the direction of the working fluid flow goes from low pressure to high pressure as it is directed radially inward through the crescent-shaped translatable chamber. Balance of power beyond that provided by the expander scroll member to the compressor scroll member can be provided by the electric motor.

According to another aspect of the invention, a scroll device adapted to operate in a hybrid mode is disclosed. The device includes a housing that contains a pair of axially-spaced scroll members, an antirotation device connected to each axially-spaced scroll member, a shaft disposed between the pair of axially spaced scroll members and an electric generator rotatably responsive to the shaft. The electric generator also includes a stator that is in inductive electrical communication with the rotor such that, upon rotation of the shaft, an alternating current electrical output of first frequency is produced in the stator. The first of the pair of axially-spaced scroll members is a compressor, such that, during operation, a working fluid is introduced into a scroll intake port at the periphery of the scroll member, and discharged at a higher pressure from a scroll discharge port in the scroll center. The second of the pair of axially-spaced scroll members is an expander, such that, during simultaneous operation with the first scroll member, a working fluid is introduced into a central scroll intake port in the scroll, and discharged at a lower pressure from a peripheral scroll discharge port. Excess power, produced by the scroll expander and not utilized by the scroll compressor, may be converted into electricity with the electric generator.

Optionally, the scroll device may include a throttle valve. The throttle valve is configured so that it can be in fluid communication with an externally disposed working fluid supply. An inlet manifold is in fluid communication with the throttle valve, and splits the working fluid into two circuits, each circuit feeding one of the axially-spaced scroll members. Each of the scroll members includes a fixed scroll defined by a central axis, a working fluid intake, an orbiting scroll meshed with and adapted to move relative to the fixed scroll, at least one crescent-shaped translatable chamber meshedly formed between the fixed and orbiting scrolls, a working fluid discharge. The scroll device may also include eccentric pins mounted to the ends of the shaft to effect mechanical communication between the axially-spaced scroll members. The degree of the pin eccentric motion relative to a central rotation axis of the shaft is equal to that of the radius of the orbiting scroll's orbital path. A speed sensor is placed such that it can measure the first frequency produced by the stator. A controller compares the first frequency signal generated by the speed sensor against a predetermined second frequency, and can send a signal to reposition the throttle valve if needed to reduce or eliminate the frequency difference. The pressure-sensing devices operate to reduce the likelihood that a static pressure within the crescent-shaped translatable chambers falls below that of the scroll member discharge/housing expansion volume. A heat exchanger is positioned such that it is in thermal communication with the stator coil. A lubrication pump is powered by at least one of the orbiting scrolls, either directly or indirectly, and can provide lubrication to high pressure regions, such as inside the scroll members. It can also be used to provide low pressure lubrication to bearings, journals and related low pressure locations. Furthermore, as with the previous embodiment, the housing may be hermetically sealed.

According to yet another aspect of the present invention, a hermetically sealed scroll expander with integral output regulation is disclosed. The expander includes a housing with a hermetically sealed interior, a throttle valve disposed on the housing, an involute spiral wrap device including first and second pairs of meshed, axially-spaced involute scroll members connected by a common shaft, an electric generator with a rotor and a stator coil, a speed sensor, and a controller in signal communication with the throttle valve and speed sensor. Each pair of involute spiral wrap members includes a fixed scroll defined by a central axis and a spiral wrap extending from a fixed scroll end plate, a scroll intake, an orbiting scroll defined by a spiral wrap extending from an orbiting scroll end plate, a scroll intake adapted to move relative to the fixed scroll, at least one translatable chamber formed between the fixed and the orbiting scroll, a scroll discharge in intermittent fluid communication with the scroll intake through the translatable chamber, and a rotation prevention device for preventing rotational motion of the orbiting scroll relative to the fixed scroll. A fluid expansion volume within the housing defines the sealed interior. The throttle valve is in fluid communication with an inlet manifold, and is adapted to be in fluid communication with an externally disposed working fluid supply. The electric generator is in inductive electrical communication with the shaft such that upon rotation of the shaft, an alternating current electrical output of first frequency is produced in the stator coil. The speed sensor is adapted to measure the first frequency, while a controller in signal communication with the speed sensor is placed such that upon difference between a predetermined second frequency and the first frequency, the controller is adapted to reposition the throttle valve until the difference between the first and second frequencies disappears.

Optionally, the hermetically sealed scroll expander may contain one or more differential pressure valves operably responsive to predetermined adverse pressure gradients between the translatable chamber and the internal ambient environment within the remainder of the housing. The differential pressure valve is responsive to a static pressure difference such that when the static pressure within the internal ambient environment exceeds that of the static pressure within the translatable chamber, the differential pressure valve permits at least a partial equalization of the static pressures to take place within the translatable chamber.

According to still another aspect of the present invention, a method for operating a hermetically sealed scroll expander is disclosed. The method includes defining an internal ambient environment of a housing containing an expansion volume, positioning a throttle valve on the housing, positioning an involute spiral wrap device that includes first and second pairs of axially-spaced scroll members, using a shaft to effect mechanical communication between the axially-spaced scroll members, mechanically joining the shaft to an electric generator, rotating the shaft, introducing a working fluid, expanding the working fluid, generating an electrical output, using a speed sensor, and operating a controller in signal communication with the throttle valve and the speed sensor. Each pair of axially-spaced scroll members comprises a fixed scroll defined by a central axis, a working fluid intake disposed adjacent the fixed scroll central axis, an orbiting scroll meshed with and adapted to move relative to the fixed scroll, at least one crescent-shaped translatable chamber meshedly formed between the fixed and orbiting scrolls, a working fluid discharge in fluid communication with the expansion volume, and a rotation prevention device operably responsive to the orbiting scroll. The throttle valve is in fluid communication with both an inlet manifold disposed on the housing and an externally disposed working fluid supply. An eccentric pin in the shaft is movable in an eccentric motion relative to the central rotational axis of the shaft, while the shaft turns in response to the eccentric motion of the pin. The working fluid introduced into the housing comes from the working fluid supply, and passes through the throttle valve and the pairs of axially-spaced scroll members. The orbital motion of the orbiting scrolls due to the expansion of the working fluid induces eccentric pin and shaft movement, the latter of which turns a rotor relative to a stator coil in the electric generator. The stator coil, which is in inductive electrical communication with the rotor, produces an alternating current electrical output of first frequency. The speed sensor is adapted to measure the first frequency, while the controller compares the signal from the speed sensor, and, if necessary, sends a signal to reposition the throttle valve until the first and second frequencies are the same.

Optionally, the method may include the additional step of hermetically sealing the housing prior to introducing the working fluid from the working fluid supply into the housing through the throttle valve such that cross-talk between the internal part of the housing and the external environment is avoided. An additional step could include operating a plurality of differential pressure valves disposed within the housing, such that differences in static pressure between the crescent-shaped translatable chamber and the expansion volume (also known as the internal ambient environment) within the housing, where the static pressure within the expansion volume exceeds that of the crescent-shaped translatable chamber, are minimized. This permits at least partial equalization of the static pressure differences to take place within the translatable chamber.

According to another aspect of the present invention, a method for operating a scroll device in a hybrid mode is disclosed. The method includes defining an internal ambient environment of a housing containing an expansion volume, positioning a throttle valve on the housing, positioning an involute spiral wrap device that includes first and second pairs of axially-spaced scroll members, configuring the first scroll member pair to operate in a working fluid compressor mode, configuring the second scroll member pair to operate in a working fluid expander mode, using a linkage to effect mechanical communication between the scroll members, mechanically joining the shaft to an electric generator, introducing a portion of the working fluid to each scroll member pair, simultaneously compressing the portion of the working fluid introduced into the first scroll member pair and expanding the portion of the working fluid introduced into the second scroll member pair, rotating the shaft, generating an electrical output, using a speed sensor, and operating a controller in signal communication with the throttle valve and the speed sensor. Each pair of axially-spaced scroll members comprises a fixed scroll defined by a central axis, a working fluid intake, an orbiting scroll meshed with and adapted to move relative to the fixed scroll, at least one crescent-shaped translatable chamber meshedly formed between the fixed and orbiting scrolls, a working fluid discharge, and a rotation prevention device operably responsive to the orbiting scroll. The throttle valve is in fluid communication with both an inlet manifold, which may be disposed on the housing, and an externally disposed working fluid supply. A linkage pin in the shaft is movable in an eccentric motion relative to the central rotational axis of the shaft, while the shaft turns in response to the eccentric motion of the pin. The orbital motion of the orbiting scroll induces pin and shaft movement, the latter of which turns a rotor relative to a stator in the electric generator. The stator, which is in inductive electrical communication with the rotor, produces an alternating current electrical output of first frequency. The speed sensor is adapted to measure the first frequency, while the controller compares the signal from the speed sensor, and, if necessary, sends a signal to reposition the throttle valve until the first and second frequencies are the same.

It is contemplated that variations in procedures, structural features and arrangement of parts may appear to a person skilled in the art without departing from the scope of or sacrificing any of the advantages of the invention. Accordingly, other features and advantages of the invention will be apparent from the following description, the accompanying drawings and appended claims.

Although preferred embodiments of the invention have been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION

Figure 1A:
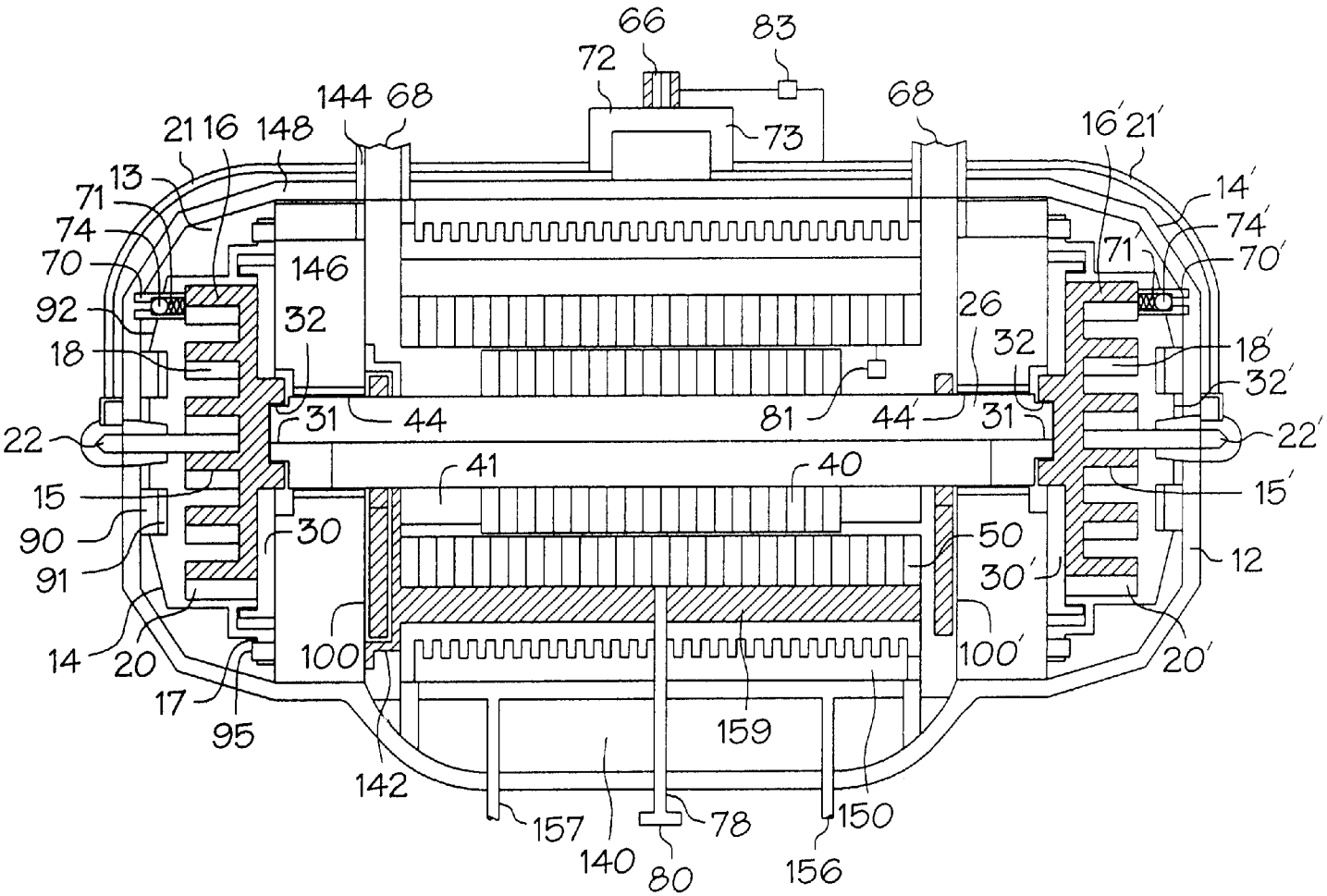
FIG. 1A is a schematic view of a scroll unit illustrating use of opposing spiral wrap member pairs according to an embodiment of the present invention.
Figure 1B:
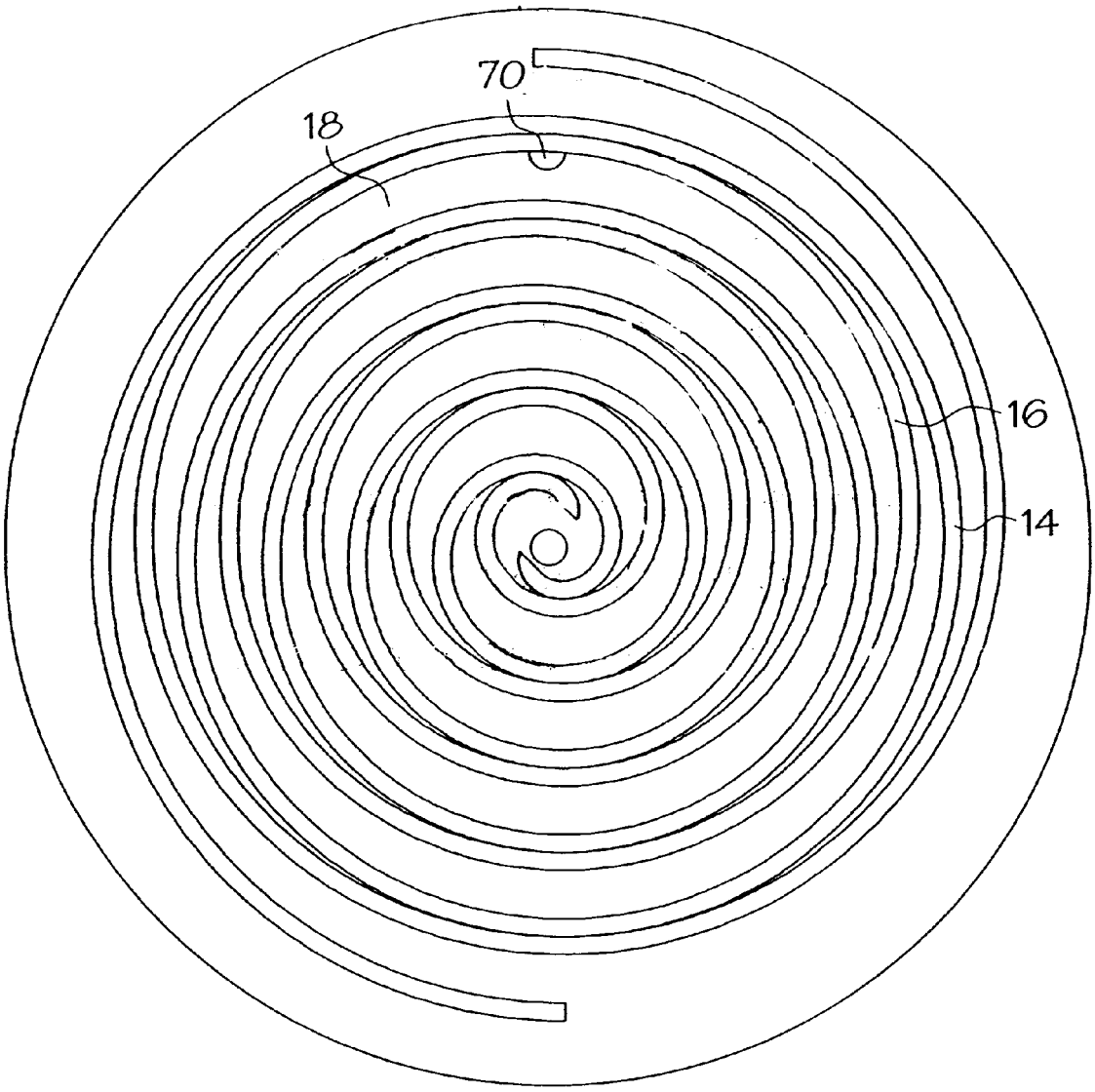
FIG. 1B is a simplified cutaway schematic view of one end of the scroll unit of FIG. 1A, with specific emphasis on the interrelation between one of the fixed and orbiting scroll pairs.

With reference to the drawings and initially to the schematic drawing of FIGS. 1A and 1B, an involute spiral wrap device 10, which can be used in an expansion or hybrid mode, includes a housing 12. The space defining the housing interior not otherwise occupied by internally situated components is the fixed expansion volume 13. The pressure and temperature regimes extant in the fixed expansion volume 13 are referred to as the internal ambient environment. First and second opposedly mounted axially extending involute spiral wrap member pairs (alternatively referred to as scroll members) 15 and 15' connected to support structure 17 integral with the housing 12. The terms "coupled", "connected" and "directly connected" refer to the contact relationship between cooperative components in decreasing levels of generality. Thus "coupled" includes any degree of causal joining between the components, regardless of how remote. When two or more components are "connected", they can be joined either directly, or through indirect contact, such as through a mutually connecting part. When components are "directly connected", they join together such that no parts fit in-between. Accordingly, in the present scenario, the contact between the scroll members and the housing is best described as connected, where the conventional use of bearings, bearing housings and support mounts (none of which are shown) fixedly attached to the housing provide mechanical support and attachment between the various components. Fixed scrolls 14, 14' are meshed with corresponding orbiting scrolls 16, 16' respectively, with the first intermeshed set particularly shown in FIG. 1B, to define crescent-shaped translatable chambers 18, 18' therebetween. The chambers 18, 18' are translatable in that they move radially between first ports 22, 22' and second ports 20, 20' as orbiting scrolls 16, 16' move relative to the fixed scrolls 14, 14'. In the expansion mode, high pressure working fluid (not shown) enters through working fluid inlet 66, passes through throttle valve 72, and then is divided at a manifold 73. From there, it is carried along inlet circuits 21 , 21', which may be external to the hermetic housing 12 to facilitate serviceability, then enters the housing 12 through first ports 22, 22' in their capacity as scroll intake, and expands in chambers 18, 18', causing orbiting scrolls 16, 16' to move. Once the fluid's energy is given up to perform orbital work on chambers 18, 18', it passes through the second ports 20, 20', acting in their scroll discharge capacity, to collect in the internal ambient environment of fluid expansion volume 13 defined by the walls of the housing 12, and then leaves by means of one or more housing outlets 68 to be subsequently discharged. Antirotation devices 30, 30' and eccentric pins 31, 31' disposed at each end of shaft 26, have their orbital motion converted to purely rotational motion in shaft 26. An eccentric bushing 32, 32' is offset from the central rotational axis of shaft 26 by an amount equal to the orbiting radius of orbiting scrolls 16, 16'.

Electrical generation is provided by means of an electric motor/generator 35 (alternately referred to as a generator when in a purely expansion electricity-generating mode), which includes a rotor 40 attached to shaft 26 and a stator 50. Stator 50, which is circumferentially mounted relative to rotor 40, is made up of numerous windings of electrically conductive wire. As such, the stator 50 is in electrical communication with rotor 40. The term "electrical communication" may encompass not only direct contact between conductive bodies and connected contact via conductive lines, wires and cables, but also the inductive coupling of non-contacting conductive members such as those found in conventional induction motors. Stator 50 passes alternating current produced in the motor/generator through electrical conductors 78 and into electrical connector 80. In hybrid mode, the process is reversed (at least with regard to one of the spiral wrap member pairs 15', for example), with a motive force being externally applied to the motor/generator 35, which in turn induces rotation in rotor 40. In an alternate configuration, the motor and generator functions of the motor/generator 35 need not be performed by a common device. Instead, they may be divided into two separate dedicated modules (not shown). This rotational movement becomes a combined rotational/translational motion in eccentric shaft 26, which through rotation prevention device 30' becomes purely orbital motion in spiral wrap pair 15'. This causes chamber 18' to move from second port 20', which now serve as the inlet, to first port 22', now the discharge, and compressing the working fluid trapped therein along the way. During hybrid mode operation, the other spiral wrap member pair, 15', for example, which is still being powered by the expansion of working fluid through its translatable chamber 18, can deliver power to the motor/generator 35, thus reducing the motor/generator's electricity needs from the external motive force.

Fixed scrolls 14, 14' are typically fixed by securing them to housing 12 via end plates 38, 38'. The rotation prevention devices 30, 30' are used to maintain only the orbiting motion of orbiting scrolls 16, 16' with respect to fixed scrolls 14, 14' such that their angular orientation is preserved throughout the full 360° range of rotation. Conventional devices such as Oldham couplings and ball-ring assemblies are used to prevent orbiting scrolls 16, 16' from rotating. In the specific embodiment depicted in the figure, the rotation prevention devices 30, 30' are Oldham couplings that consist of a flat ring 32, 32' with a pair of detents extending away from each axial side. One pair of detents engage complementary apertures that define a small orbiting path such that the orbiting scrolls 16, 16' follow the first detents to trace the orbital path, while the other pair of detents engage either the fixed scrolls 14, 14' or a fixed mounting structure within the housing 12. This second pair of detents prohibits the orbiting scrolls 16, 16' from rotating, while the first pair of detents permits the orbital motion. Shaft 26 is attached to end plates 39, 39' of orbiting scrolls 16, 16' through the eccentric pins 31, 31' that are integral to each end of shaft 26. The offset of each eccentric pin 31, 31' from the central rotational axis 26A is equal to the orbital radius of the orbiting scrolls 16, 16'.

Figure 2:
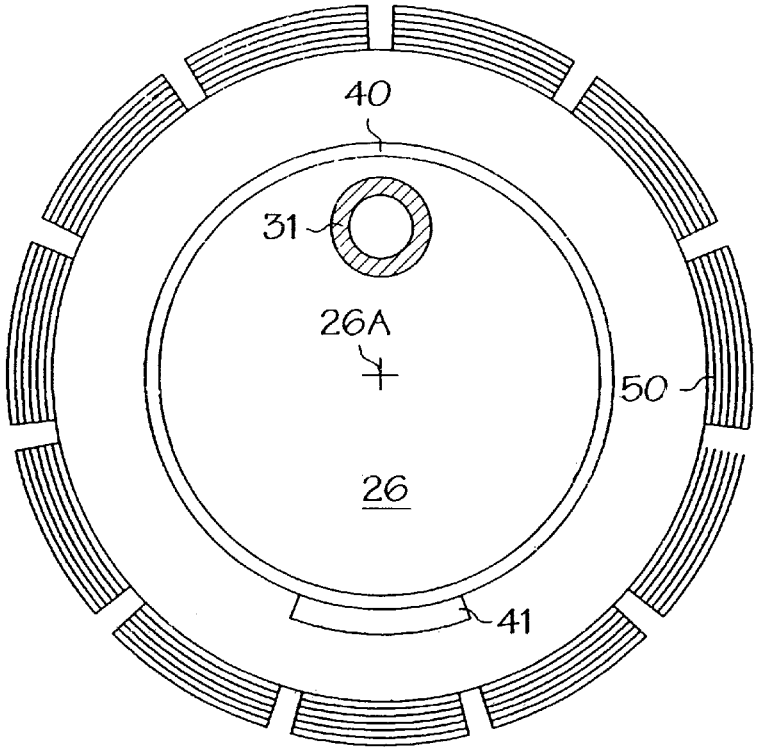
FIG. 2 is an end view showing the linkage used to convert the orbiting motion of the shaft to the rotating motion of the rotatable disk rotor.

Referring additionally now to FIG. 2, which reveals an axial, end-on view of shaft 26 with central rotational axis 26A, rotor 40, counterweight 41, stator 50, and eccentric pin 31. The use of the offset in eccentric pin 31 (as well as its opposing end counterpart, 31', not shown in this figure ) in conjunction with the antirotation device 30 (and 30', also not shown in this figure) converts the hypocycloidal motion of the orbiting scroll 16, 16' (not shown in this figure) to pure rotational motion of shaft 26along central rotational axis 26A . Referring again to FIG. 1A, preferably bearings 44, 44', such as journal bearings, are pressed into offset, eccentric bushings 46, 46' and receive eccentric pins 31, 31' of shaft 26. To dynamically balance the radial loads, the counterweight 41 is added onto the shaft 26 diametrically opposite the side with eccentric pins 31, 31'.

Housing 12 can form a hermetically sealed unit. As used here, "hermetically sealed" means that all moving parts, including scrolls, shafts, linkages and rotatable disks are contained within housing 12 such that they are impervious to harsh external environments, as well as preventing the inadvertent release of working fluids and lubrication system elements into the environment. Accordingly, there are no shaft seals or other moving mechanical parts that extend through the housing 12, although electrical conductors 78, preferably in the form of a hermetic electrical plug fitting, are used to pass electrical power through the housing walls. Similarly, cooling lines 151 permit the flow of coolant across the hermetic boundary. Typically, the housing 12 consists of two or more sections 12*a*, 12*b* that are sealed together. As shown in FIG. 1A, sections 12*a*, 12*b* have flanges 76, 76' with flange 76 containing a sealing O-ring 64. Flanges 76, 76' are secured by fasteners such as bolts 74. Alternatively, and for a more effective seal, the housing sections 12*a*, 12*b* may be welded or brazed to each other. A hermetically sealed housing 12 is especially effective when an electrical motor/generator 35 is used in conjunction with the rotor 40, where electrical conductors 78 pass through housing 12 and provide power to or receive power from an external device via electrical connector 80 mounted on the exterior of the housing 12.

An involute spiral wrap device with double spiral wrap member pairs 15, 15' has several advantages. First, the double wrap member pairs, through their smaller size, permit reduced radial loads for a given displacement. Second, the reduced physical size of the scroll leads to lower mechanical stress in the scroll components. Third, the smaller size of the scrolls facilitates smaller bearings. Fourth, mechanical losses are lowered, as inertial effects and friction loads are reduced. Fifth, the axial thrust load levels are reduced in an amount directly proportional to the reduction in area. Sixth, the volumetrically efficient scrolls result from dividing a single spiral wrap member 15 into two paired sets 15, 15' affords a high aspect ratio scroll wall that translates into smaller housing footprint and girth. Seventh, manufacturing of two smaller scrolls is more cost-effective than with one larger unit. Moreover, any buildup of heat within the scrolls is spread to opposing ends of the involute spiral wrap device 10, rather than concentrating it all within a single orbital wrap location.

Figure 3:
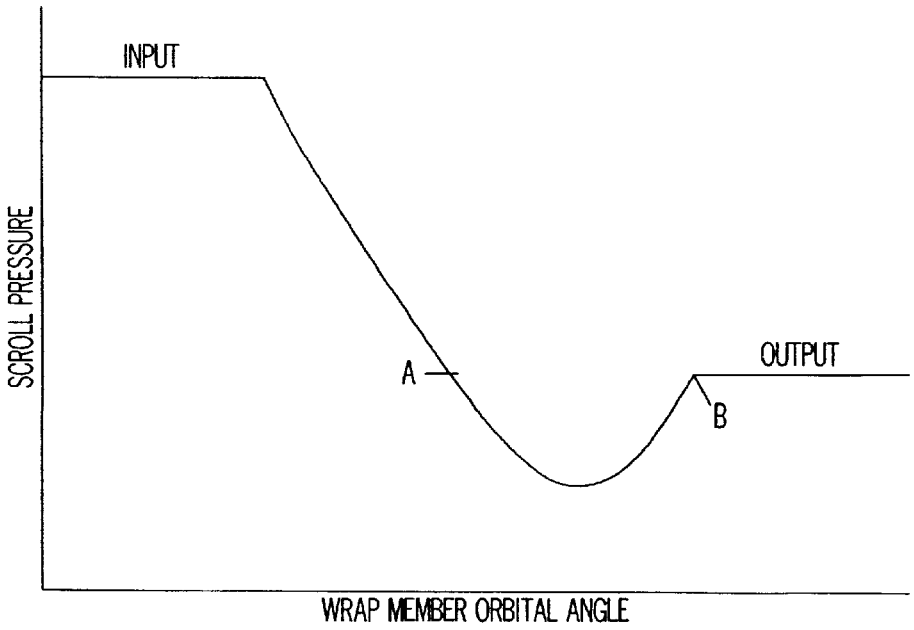
FIG. 3 is a graph showing negative pressure effects during certain operational regimes.

As shown in FIG. 3, in conjunction with FIGS. 1A and 1B, under certain conditions, such as reduced working fluid pressure operation positions A–B(shown in FIG. 3), as an expanding fluid drives the orbiting scrolls 16, 16' in orbiting motion, the pressure in the chambers 18, 18' drops below the output (i.e.: internal ambient environment) pressure, causing reduced efficiency of the spiral wrap member pairs 15, 15' as they work against this additional exit pressure load. This is a well-known concept of scroll device operation and is a consequence of the defined volume of the crescent-shaped translatable chambers 18, 18'. To alleviate this problem, differential pressure valves 70 (a portion of which can be seen in FIG. 1B), 70', such as poppet valves or reed valves, are used to allow working fluid at internal ambient environment pressure conditions to communicate with chambers 18, 18'. In the expander mode, pressure from spring 71, 71' maintains the balls 74, 74' in a seated position and prevents the working fluid in the fluid expansion volume 13 from entering chambers 18, 18' when chamber pressure is above the internal ambient environment pressure of the working fluid. When the pressure in chambers 18, 18' drops below the internal ambient environment pressure, balls 74, 74' unseat and allow working fluid from the fluid expansion volume 13 of housing 12 to enter chambers 18, 18', thus eliminating or minimizing adverse pressure gradients. Multiple valves may be used with each wrap member pair.

When operating scroll unit 10 as an expander, it is desirable to control the amount of working fluid entering into the pairs of meshed axially extending involute spiral wrap members 15, 15' in order to maintain a constant rotational speed, and hence a constant alternating current output frequency. As shown in FIG. 1A, a throttle valve 72 is used to control the amount of working fluid delivered to the involute spiral wrap member pairs 15, 15'. One method by which the throttle valve 72 is operated is with a rotational speed sensor 81 and controller 83 arranged in a feedback loop. Speed sensor 81 measures the rotational speed of rotor 40; this speed, which can be correlated to an output frequency, is then sent to the controller 83, which compares the output frequency to a predetermined value (such as 60 Hz) and, depending on rotor speed, adjusts the amount of working fluid delivered by means of valve 72.

Figure 1C:
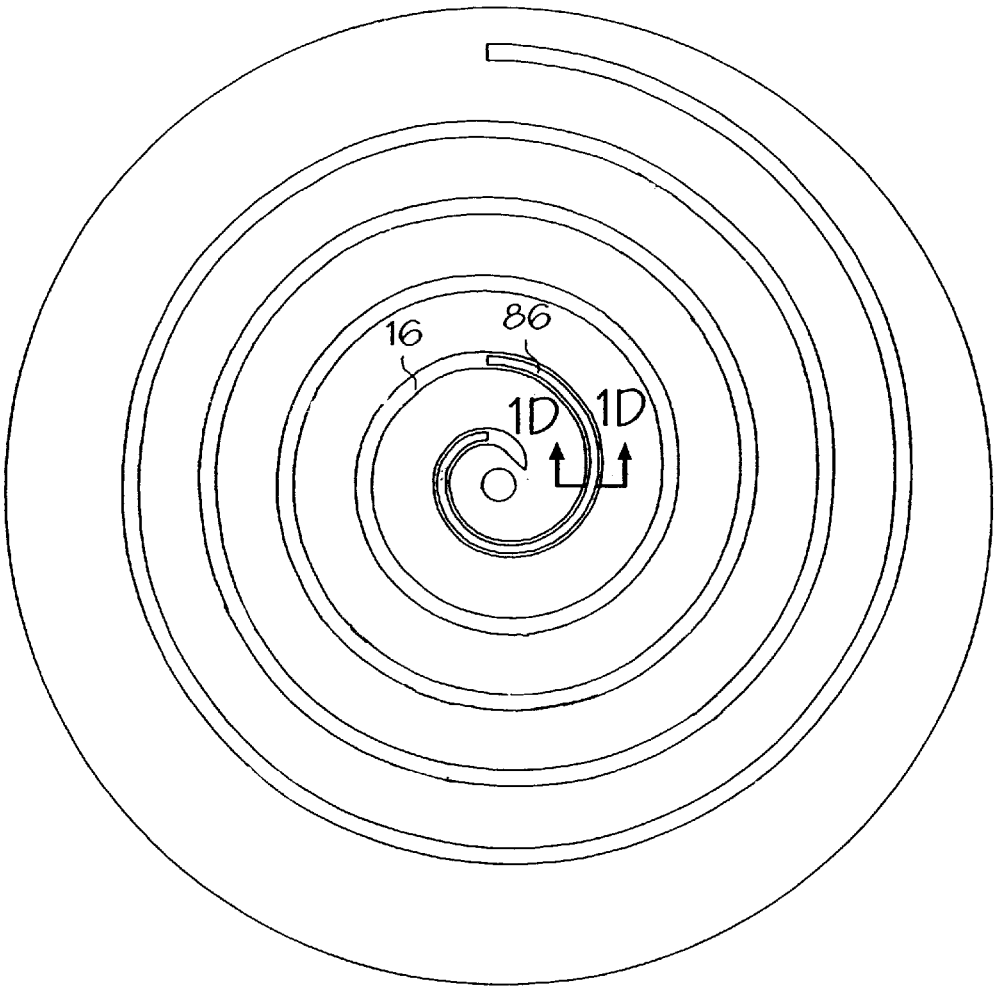
FIG. 1C is a further simplified cutaway schematic view of one end of the scroll unit of FIG. 1A, with specific emphasis on tip sealing features for one of the orbiting scrolls.
Figure 1D:
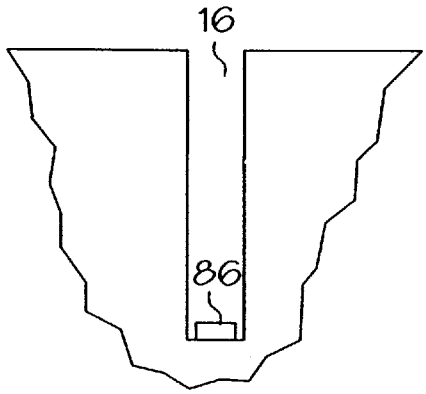
FIG. 1D is a cutaway view of one part of the orbiting scrolls taken along cut line 1D—1D, showing a representative placement of a tip seal.

In order to minimize scroll leakage, scroll members 14, 14' 16 and 16' may include various axial compliance schemes. One approach is to incorporate a symmetric integral tension feature 90, 90' on each end that forces the fixed scroll members 14, 14' axially toward orbiting scroll members 16, 16'. Confined gas pressure pockets 91, 91' places pressure on the end plates 38, 38' of fixed scroll members 14, 14' through a confined gas pressure pocket fluid transfer paths 92, 92'. Confined gas pressure pocket fluid transfer path 92, 92' is in fluid communication with the crescent-shaped translatable chambers 18, 18', thus permitting some of the overpressure in the chamber 18, 18' that would otherwise force the wrap members 14, 14' away from wrap members 16, 16' to apply pressure to end plates 38, 38' to keep axial gaps to a minimum. In the alternative, the integral tension feature may employ some other biasing means, such as by spring. Another approach to axial compliance to effect a relatively leak-free barrier between the wrap member and the end plate of the member's meshed counterpart could involve the use of tip seals 86, 86'. Referring now to FIGS. 1C and 1D, seals 86, 86' are formed in a slight groove at the end of fixed scrolls 14, 14' for engagement with end plates 39, 39' of orbiting scrolls 16, 16'. Similar seals are used with the orbiting scrolls 16, 16' and the end plates 38, 38' of fixed scrolls 14, 14', as shown in FIG. 1C. Tip seals are formed of low carbon steel or iron when high temperatures are encountered in the wrap member pair or Teflon-based materials when used for lower operational temperatures. In either case, various biasing means may be employed to force the tip seals 86, 86' against the opposing end plate, such as springs, fluid pressure applied on the backside of the tip seal through gaps in the scroll, or inherent springiness in the tip seal material. Similarly, axially aligned pins 95, 95' are used to ensure that misalignment and gap formation does not occur between the orbiting scroll and the housing during thermal growth.

Figure 4:
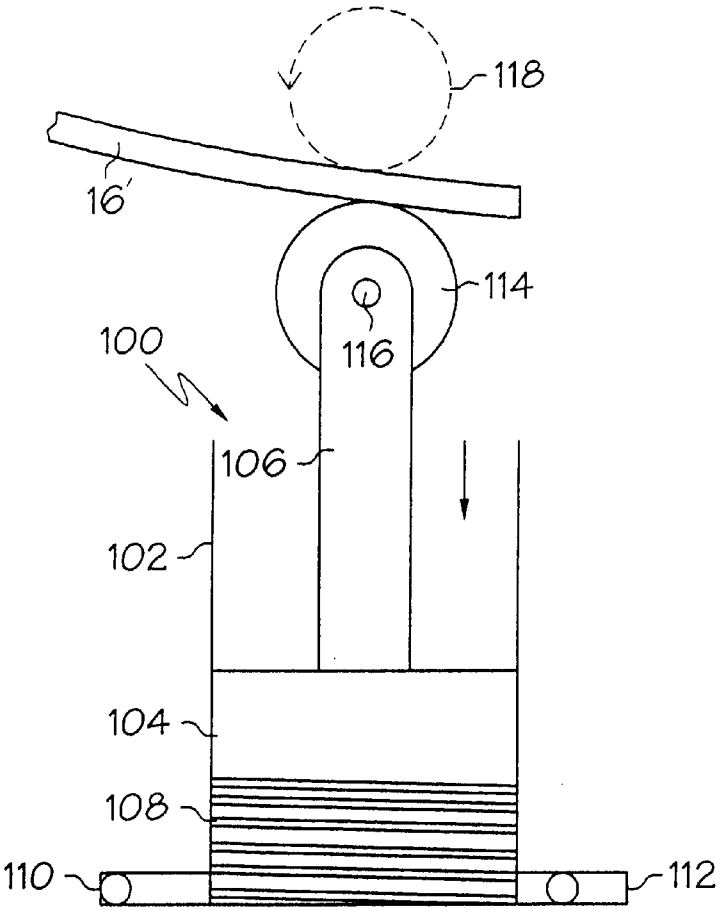
FIG. 4 is a schematic view of a pump driven directly by the orbiting motion of a spiral wrap member using a return spring and follower wheel.

Referring now to FIG. 4, the auxiliary power source may be in the form of a lubrication pump 100, 100', which is operated by the eccentric motion of orbiting scrolls 16, 16'. For the sake of brevity, only the details of one of the lubrication pumps (in this instance, pump 100) will be discussed. As will be appreciated by those skilled in the art, a wide variety of pumps may be used, and, as such, the pumps used in the following examples are not intended to limit the invention to a particular pump configuration. Lubrication pump 100 consists of a cylinder 102, a piston 104, a piston rod 106, a return spring 108, an inlet valve 110, and an outlet valve 112. A rotating follower wheel 114 is attached to an end of piston rod 106 by means of axle pin 116. As orbiting scroll 16 or bits downward in a circular orbit 118, it compresses return spring 108 and fluid within cylinder 102 and forces fluid out of cylinder 102 via outlet valve 112. Valve 110 is closed to incoming fluid. As the wrap member begins its upward path in its orbiting cycle, return spring 108 maintains rotating follower wheel 114 in contact with orbiting scroll 16. During this part of the cycle, outlet valve 112 moves to a closed position and inlet valve 110 moves to an open position allowing fluid to enter cylinder 102. At the top of the orbit 118, cylinder 102 is full of fluid with piston 104 at its uppermost position. Orbiting scroll 16 again begins its orbiting descent with inlet valve 110 closing and outlet valve 112 opening and fluid being expelled from cylinder 102 as piston 104 begins its downward stroke due to the downward travel of orbiting scroll 16.

Figure 5:
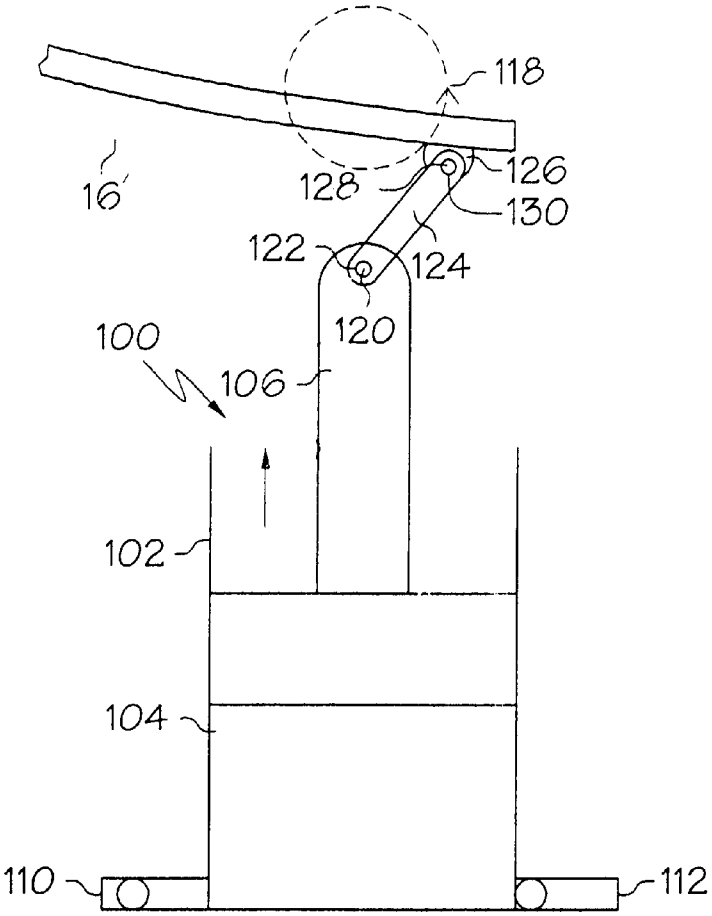
FIG. 5 is a schematic view of another embodiment of a pump driven directly by the orbiting motion of a spiral wrap member using a mechanical linkage.
Figure 6:
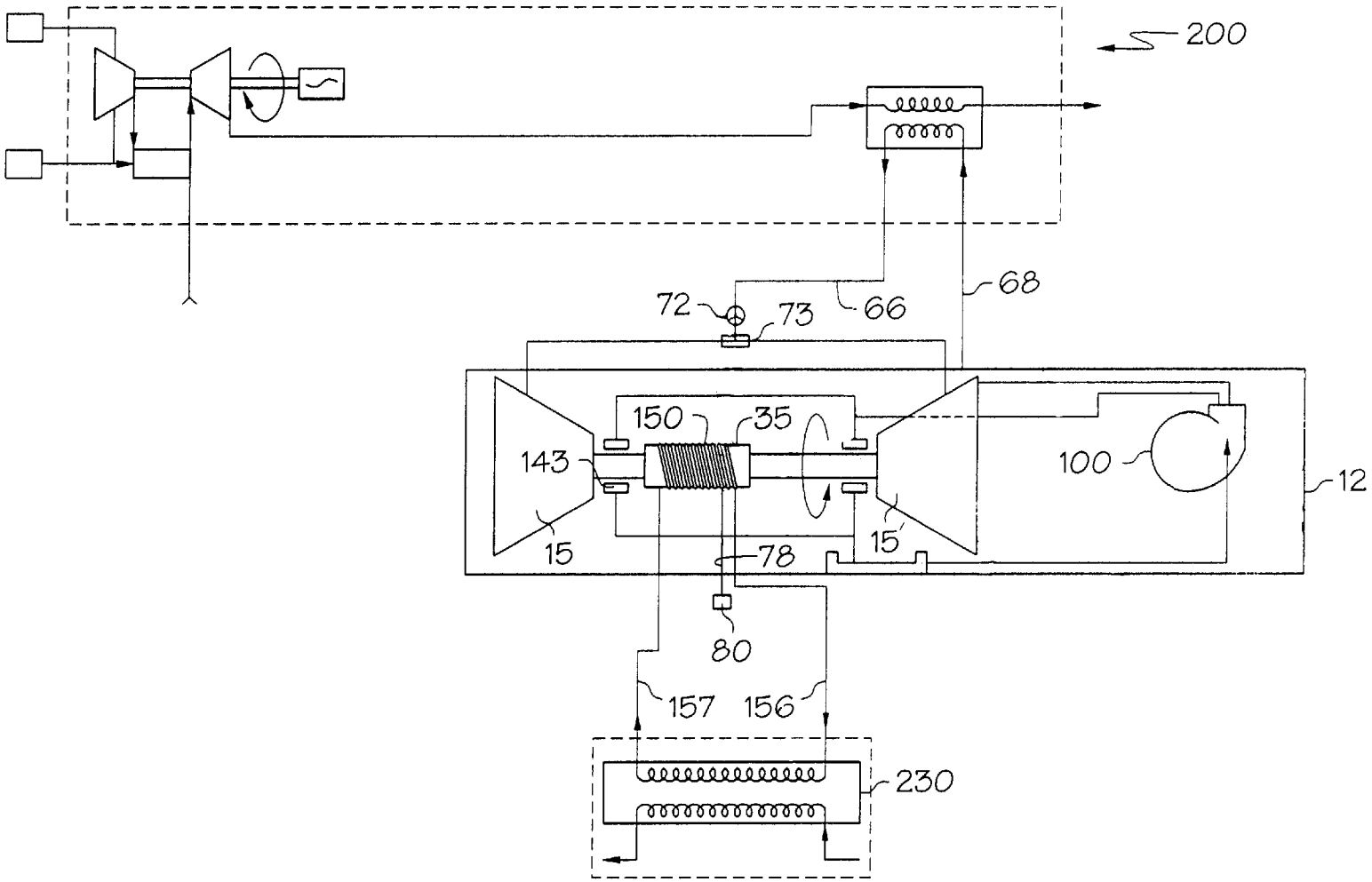
FIG. 6 is a schematic view of the integration of a scroll unit with both an external source of working fluid energy and heat exchange.

FIG. 5 illustrates another form of a pump 100 in which the return spring 108 has been eliminated. Here the piston rod 106 is mechanically linked to orbiting scroll 16. The piston rod 106 is provided with an aperture 122 at its end to which a linking arm 124 is movably attached at one end by means of wrist pin 120. Orbiting scroll 16 has a tang 126 with tang aperture 128 to which the opposite end of linking arm 124 is attached by means of second wrist pin 130. As the orbiting scroll 16 moves upward in its orbiting stroke, it pulls piston 104 upward in cylinder 102 filing cylinder 102 with fluid from open inlet valve 110. At the top of the spiral wrap orbit, inlet valve 110 closes and outlet valve opens to allow for the expulsion of fluid from cylinder 102 by piston 104 during the downward travel of orbiting scroll 16. It is noted that the pump 100 can be tuned to high or low pressure operation. For example, in situations requiring high pressure operation, such as the lubrication of components in the high fluid pressure regions of the scroll member 15, the pump output can be of corresponding high pressure. Likewise, in low pressure lubrication situations, such as those involving the shaft or linkage operation, the pump output pressure may be lowered. For example, as shown in FIG. 6, bearings 143 can be lubricated with the low pressure system. In a like manner, one pump 100 can be used for high pressure applications, while the other pump 100' can be used in situations calling for low pressure lubrication.

FIG. 1A shows conceptually the placement of another form of pump 100 in a gear-driven configuration, where the pump 100 is driven off the rotation of shaft 26. Oil sump 140 provides a reservoir for oil and related lubricants, while other parts of the lubrication circuit, including pump suction line 142, oil drain 144, shaft lubricant fillings 146 and oil separator housing 148 are depicted in their respective positions with the housing 12.

Figure 7:
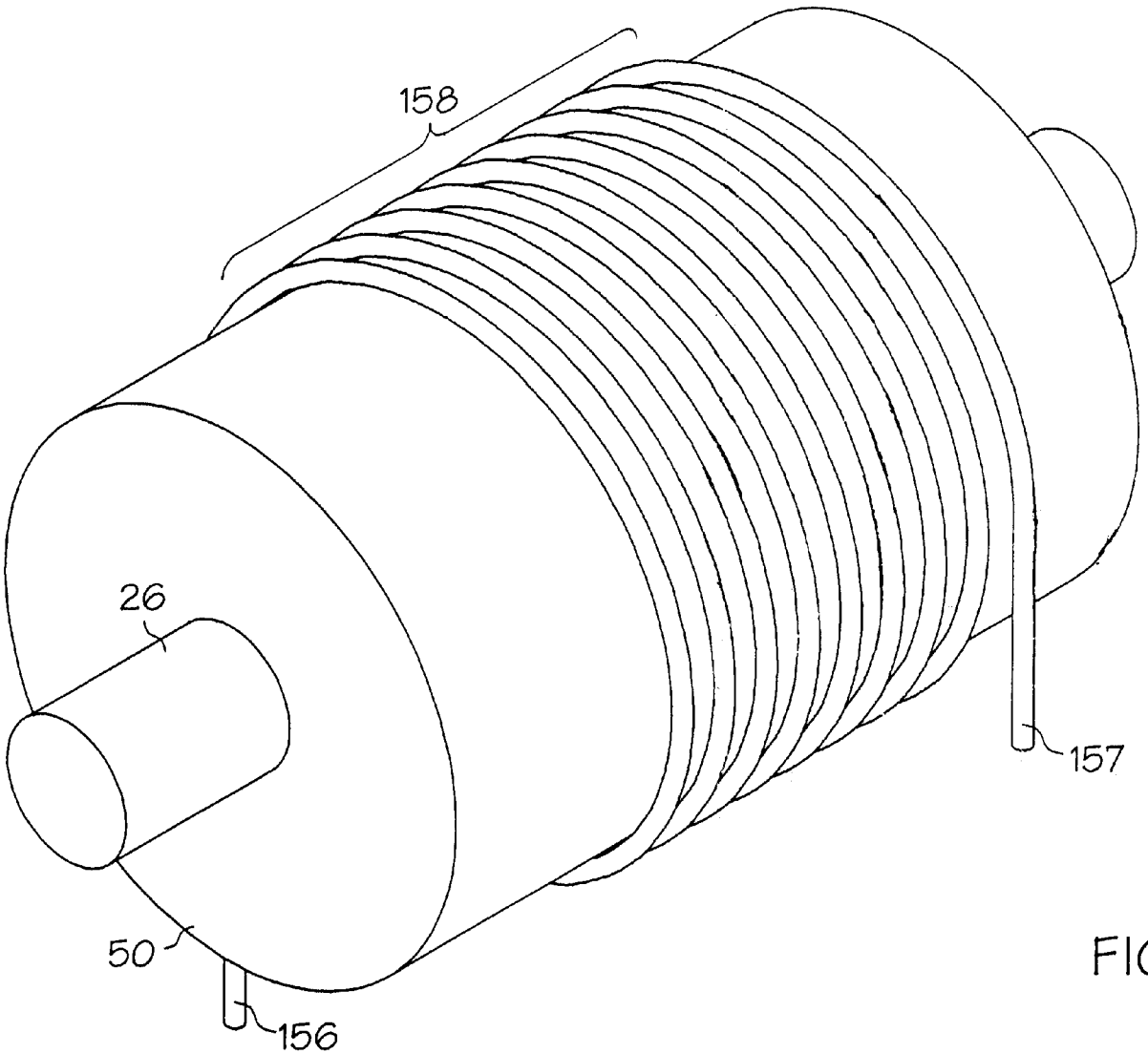
FIG. 7 is a perspective view of the heat exchanger and stator.

The removal of excess heat buildup is especially useful in increased-capacity scroll devices with integral electric motor/generators in hermetically sealed containers, where the additional heat generation due to the motor/generator is occurring without a concomitant heat removal capability due to the unavailability of convective heat removal. To this end, and as shown in FIGS. 1A, 6 and 7, a heat exchanger 150 is placed radially outward of the stator 50. The heat exchanger 150 comprises a helical-shaped coil 152 that is used as conduit to transport a heat exchange fluid such that it is in thermal communication with either stator 50 or a specially adapted thermally conductive annular housing 159 that sheaths stator 50. In a preferred embodiment, the excess heat emanating from the stator 50 passes over helical-shaped conduit 158 and exchanges heat with the fluid passing therethrough. The fluid in the heat exchanger 150, which enters and exits through penetrations 156, 157 in the housing 12, can be part of a separate cooling circuit 230. If integrated with another system, the heat given up to heat exchanger 150 from stator 50 can be used elsewhere, such as a preheat for an external thermal system (such as a conventional Rankine cycle 200). The helical wrapping permits both an efficient, compact structure, as well as large surface area for maximum heat exchange effectiveness.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

What is claimed is:

1. An involute spiral wrap device adapted to operate in at least an expansion mode or a hybrid mode, said involute spiral wrap device comprising:

a hermetically sealable housing with a plurality of mounting surfaces disposed on an interior wall thereof, said housing defining an interior ambient environment, said housing including:

a working fluid inlet and at least one working fluid outlet, each disposed across a boundary of said hermetically sealable housing;

a throttle valve in fluid communication with at least one of a working fluid inlet or said working fluid outlet to regulate the flow of a working fluid crossing said boundary of said hermetically sealable housing; and at least one electrically conductive power line disposed across a boundary of said hermetically sealable housing;

a first pair of scroll members disposed within said housing, said first pair of scroll members comprising:

a fixed scroll and an orbiting scroll, each with an end plate and an involute spiral wrap attached thereto;

at least one generally crescent-shaped translatable chamber formed by the juxtaposition of said orbiting scroll to said fixed scroll, said generally crescent-shaped translatable chamber capable of radial movement upon orbital motion of said orbiting scroll relative to said fixed scroll;

a fluid path defined by at least one scroll intake and at least one scroll discharge, each in respective fluid communication with said working fluid inlet and said at least one working fluid outlet, said at least one scroll intake and at least one scroll discharge separated from one another by said generally crescent-shaped translatable chamber such that said orbital motion of said orbiting scroll, and the passage of said working fluid from said at least one scroll intake, through said generally crescent-shaped translatable chamber, and out said at least one scroll discharge are operatively responsive to one another; and a rotation prevention apparatus mechanically coupled to said orbiting scroll and at least one of said fixed scroll or one of said plurality of mounting surfaces;

a second pair of scroll members substantially axially aligned with and configurationally similar to said first pair of scroll members save that said second pair of scroll members are oriented in the opposing axial direction from said first pair of scroll members;

a rotatable shaft disposed between said first and second orbiting scroll members such that said shaft maintains them in an axially spaced relationship;

a linkage coupled to said shaft such that said linkage is eccentrically mounted relative to a central rotation axis of said shaft;

an electric motor/generator in cooperative engagement with said rotatable shaft, said motor/generator comprising:

a rotor disposed on said shaft; and a stator in electrical communication with said rotor, said stator mounted to said housing and electrically connected to said at least one electrically conductive power line;

at least one heat exchanger in thermal communication with said stator;

an auxiliary power source adapted to provide additional power to at least one component within said housing; and at least one differential pressure valve in fluid communication with said translatable chamber and said internal ambient environment, said differential pressure valve operably responsive to select differences in static pressure between said translatable chamber and said internal ambient environment.

2. The involute spiral wrap device according to claim 1, wherein said at least one heat exchanger is either disposed substantially within, or affixed to, said housing.

3. The involute spiral wrap device according to claim 1, wherein said auxiliary power source is disposed within said housing, and is in cooperative engagement with said orbiting scroll.

4. The involute spiral wrap device according to claim 2, wherein said at least one heat exchanger is circumferentially disposed in relation to said stator.

5. The involute spiral wrap device according to claim 1, wherein said first pair of scroll members define a compressor, while said second pair of scroll members simultaneously define an expander.

6. The involute spiral wrap device according to claim 1, wherein said auxiliary power source includes at least one lubrication pump adapted to provide power to at least one lubrication system disposed within said housing.

7. The involute spiral wrap device according to claim 6, wherein said at least one lubrication system includes a high pressure circuit.

8. The involute spiral wrap device according to claim 6, wherein said at least one lubrication system includes a low pressure circuit.

9. The involute spiral wrap device according to claim 1, further comprising at least one axial compliance member to prevent axial displacement of at least one of said fixed scrolls relative to its orbiting scroll counterpart by more than a predetermined amount.

10. The involute spiral wrap device according to claim 9, wherein said at least one axial compliance member is a pneumatically actuated integral tension device in fluid communication with at least one of said fixed or orbiting scroll end plates.

11. The involute spiral wrap device according to claim 9, wherein said at least one axial compliance member includes a tip seal disposed on at least one of said fixed or orbiting scrolls.

12. The involute spiral wrap device according to claim 1, wherein said auxiliary power system includes at least one condensate pump disposed within said hermetically sealable housing, said condensate pump connected to a condensate handling system, and adapted to increase the pressure of said working fluid.

13. The involute spiral wrap device according to claim 1, wherein said electric motor/generator is disposed in the space defined by said axially spaced relationship between said first and second pairs of scroll members.

14. The involute spiral wrap device according to claim 1, wherein said orbiting scroll and said fixed scroll are made up of different materials.

15. The involute spiral wrap device according to claim 14, wherein said material of said orbiting scroll is predominantly aluminum.

16. The involute spiral wrap device according to claim 1, wherein said linkage is offset from the rotational axis of said rotatable shaft by an amount equivalent to the orbital radius of said orbiting scroll.

17. The involute spiral wrap device according to claim 1, further comprising at least one counterweight to minimize static and dynamic imbalances caused by said eccentric motion of said linkage.

18. The involute spiral wrap device according to claim 1, wherein said eccentric linkage comprises a pin disposed at each end of said shaft, said pin adapted to travel in an eccentric bushing disposed within said end plate of each of said orbiting scrolls.

19. The involute spiral wrap device according to claim 1, wherein said throttle valve is operably responsive to a change in rotational speed of said rotational shaft such that, upon deviation from a predetermined alternating current output frequency from said electric motor/generator, said throttle valve adjusts the flow of working fluid therethrough.

20. The involute spiral wrap device according to claim 1, further comprising an oil mist separator adapted to be in fluid communication with said working fluid.

21. A hybrid scroll device comprising:

a hermetically sealable housing, said housing defining an interior ambient environment and including:

at least one working fluid inlet and at least one working fluid outlet, each disposed across a boundary of said hermetically sealable housing; and at least one electrically conductive power line disposed across a boundary of said hermetically sealable housing;

a scroll expander pair disposed within said housing, said scroll expander pair comprising:

a fixed scroll and an orbiting scroll, each with an end plate and an involute spiral wrap attached thereto;

at least one generally crescent-shaped translatable chamber formed by the juxtaposition of said orbiting scroll to said fixed scroll, said generally crescent-shaped translatable chamber capable of radial movement upon orbital motion of said orbiting scroll relative to said fixed scroll;

a fluid path comprising:

a scroll intake in fluid communication with said at least one working fluid inlet; and a scroll discharge in fluid communication with said at least one working fluid outlet, said scroll intake and discharge separated from one another by said generally crescent-shaped translatable chamber such that said orbital motion of said orbiting scroll, and the radially outward passage of a working fluid from said scroll intake, through said generally crescent-shaped translatable chamber, and out said scroll discharge are operatively responsive to one another; and a rotation prevention apparatus mechanically coupled to said orbiting scroll; a scroll compressor pair substantially axially aligned with, and oriented in the opposing axial direction from, said scroll expander pair, said scroll compressor pair comprising substantially similar scroll configuration as that of said scroll expander pair save that said scroll compressor pair is adapted to flow said working fluid in a radially inward direction;

a rotatable shaft disposed between said scroll expander pair and said scroll compressor pair such that said shaft maintains them in an axially spaced relationship;

an electric motor in cooperative engagement with said rotatable shaft, and a linkage coupled to said shaft such that said linkage is eccentrically mounted relative to a central rotation axis of said shaft.

22. A scroll device adapted to operate in a hybrid mode, said scroll device comprising:

a housing that defines an expansion volume;

first and second axially-spaced scroll member pairs disposed within said housing, wherein said first scroll member pair defines a compressor, and said second scroll member pair defines an expander, said compressor and said expander capable of simultaneous operation, each said scroll member pair comprising:

a fixed scroll defined by a central axis;

a scroll intake disposed within said fixed scroll;

an orbiting scroll meshed with and adapted to move relative to said fixed scroll;

at least one crescent-shaped translatable chamber meshedly formed between said fixed and said orbiting scroll;

a scroll discharge; and a rotation prevention device operably responsive to said orbiting scroll;

a shaft disposed within said housing, said shaft rotatably responsive to movement produced in each of said orbiting scrolls; and an electric motor/generator with a rotor and a stator, said rotor mounted to said shaft, and said stator in inductive electrical communication with said rotor.

23. A scroll device according to claim 22, further comprising:

a throttle valve mounted to said housing, said throttle valve adapted to be in fluid communication with an externally disposed working fluid supply;

an inlet manifold in fluid communication with said throttle valve;

a speed sensor adapted to measure said first frequency; and a controller in signal communication with said throttle valve and said speed sensor such that, upon difference between a predetermined second frequency and said first frequency, said controller is adapted to reposition said throttle valve until said first and second frequencies are the same.

24. A hermetically sealed scroll expander with integral output regulation comprising:

a hermetically sealed housing with an interior volume defining an internal ambient environment;

a throttle valve mounted to said hermetically sealed housing, said throttle valve in fluid communication with both an inlet manifold and an externally disposed working fluid supply;

an involute spiral wrap device disposed within said hermetically sealed housing, said involute spiral wrap device including first and second pairs of meshed, axially-spaced involute scroll members, each pair comprising:

a fixed scroll defined by a spiral wrap extending from a fixed scroll end plate, and a central axis;

a scroll intake disposed in said fixed scroll end plate;

an orbiting scroll adapted to move relative to said fixed scroll, said orbiting scroll defined by a spiral wrap extending from an orbiting scroll end plate;

at least one translatable chamber formed between said fixed and said orbiting scroll;

a scroll discharge in intermittent fluid communication with said scroll intake via said at least one translatable chamber; and a rotation prevention device for preventing rotational motion of said orbiting scroll relative to said fixed scroll;

a linkage to effect mechanical communication between said orbiting scrolls of said first and second pairs of meshed axially-spaced involute spiral wrap members, said linkage movable in an eccentric motion relative to said central axis of said fixed scroll; and a shaft rotatably responsive to said eccentric motion of said linkage, an electric generator with a rotor and a stator coil, said electric generator in inductive electrical communication with said shaft such that, upon rotation of said shaft, an alternating current electrical output of first frequency is produced in said stator coil;

a speed sensor adapted to measure said first frequency; and a controller in signal communication with said throttle valve and said speed sensor such that, upon difference between a predetermined second frequency and said first frequency, said controller is adapted to reposition said throttle valve until said first and second frequencies are the same.

25. A hermetically sealed scroll expander according to claim 24, further comprising a plurality of differential pressure valves disposed within said housing, at least one of said plurality of differential pressure valves responsive to a predetermined difference in static pressure between said translatable chamber and said internal ambient environment.

26. A hermetically sealed scroll expander according to claim 25, wherein said plurality of differential pressure valves are operably responsive to said difference in static pressure such that when static pressure of said internal ambient environment exceeds that of said translatable chamber, said at least one of said plurality of differential pressure valves permits at least a partial equalization of said difference in static pressure to take place within said translatable chamber.

27. A method of operating a scroll expander comprising:

defining a housing containing an expansion volume;

positioning a throttle valve on said housing such that said throttle valve is in fluid communication with both an inlet manifold and an externally disposed working fluid supply;

positioning an involute spiral wrap device within said housing, said involute spiral wrap device including first and second pairs of axially-spaced scroll members, each pair comprising:

a fixed scroll defined by a central axis;

a working fluid intake disposed adjacent said central axis;

an orbiting scroll meshed with and adapted to move relative to said fixed scroll;

at least one crescent-shaped translatable chamber meshedly formed between said fixed and said orbiting scroll;

a working fluid discharge in fluid communication with said expansion volume; and a rotation prevention device operably responsive to said orbiting scroll;

using a linkage to effect mechanical communication between said pair of axially-spaced scroll members, said linkage movable in an eccentric motion relative to said central axis of said fixed scroll;

mechanically joining said linkage to a shaft;

rotating said shaft in response to said eccentric motion of said linkage;

introducing a working fluid from said working fluid supply into said housing through said throttle valve;

expanding said working fluid through said first and second pairs of axially spaced scroll members;

generating an electrical output by operating an electric generator with a rotor and a stator coil in inductive electrical communication with said shaft such that, upon rotation of said shaft due to said expansion of said working fluid, an alternating current electrical output of first frequency is produced in said stator coil;

using a speed sensor adapted to measure said first frequency;

operating a controller in signal communication with said throttle valve and said speed sensor such that, upon difference between a predetermined second frequency and said first frequency, said controller is adapted to reposition said throttle valve until said first and second frequencies are the same.

28. A method according to claim 27, comprising the additional step of: hermetically sealing said housing to define an internal ambient environment prior to said introducing a working fluid from said working fluid supply into said housing through said throttle valve, such that cross-talk between said internal part of said internal ambient environment and an external environment is avoided.

29. A method according to claim 28, comprising the additional step of: operating a plurality of differential pressure valves disposed within said housing such that when a static pressure within said internal ambient environment exceeds that within said translatable chamber, at least one of said plurality of differential pressure valves permits at least a partial equalization of static pressures to take place within said translatable chamber.

30. A method of operating a scroll device comprising:

defining an internal ambient environment of a housing containing an expansion volume;

positioning a throttle valve on said housing such that said throttle valve is in fluid communication with both an inlet manifold and an externally disposed working fluid supply;

positioning an involute spiral wrap device within said housing, said involute spiral wrap device including first and second pairs of axially-spaced scroll members, each pair comprising:

a fixed scroll defined by a central axis;

a working fluid intake;

an orbiting scroll meshed with and adapted to move relative to said fixed scroll;

at least one crescent-shaped translatable chamber meshedly formed between said fixed and said orbiting scroll;

a working fluid discharge; and a rotation prevention device operably responsive to said orbiting scroll; configuring said first pair of axially spaced scroll members to operate in a working fluid compression mode;

configuring said second pair of axially spaced scroll members to operate in a working fluid expansion mode;

using a linkage to effect mechanical communication between said pair of axially-spaced scroll members, said linkage movable in an eccentric motion relative to said central axis of said fixed scroll;

mechanically joining said linkage to a shaft;

introducing a portion of said working fluid into each said working fluid intake;

simultaneously compressing said portion of said working fluid introduced into said first pair of axially spaced scroll members and expanding said portion of said working fluid introduced into said second pair of axially spaced scroll members;

rotating said shaft in response to said eccentric motion of said linkage; generating an electrical output by operating an electric generator with a rotor and a stator in inductive electrical communication with said shaft such that, upon rotation of said shaft, an alternating current electrical output of first frequency is produced in said stator;

using a speed sensor adapted to measure said first frequency; and operating a controller in signal communication with said throttle valve and said speed sensor such that, upon difference between a predetermined second frequency and said first frequency, said controller is adapted to reposition said throttle valve until said first and second frequencies are the same.

* * * * *